United States Patent [19]

Hincklieff et al.

[11] 4,111,211

[45] Sep. 5, 1978

[54] SMOKING MIXTURES

[75] Inventors: Henry Russell Hincklieff; Richard Hugh Banwell, both of Blackley, England

[73] Assignee: Imperial Chemical Industries Limited, London, England

[21] Appl. No.: 797,017

[22] Filed: May 16, 1977

Related U.S. Application Data

[62] Division of Ser. No. 563,448, Mar. 31, 1975, abandoned.

[30] Foreign Application Priority Data

May 2, 1974 [GB] United Kingdom ..... 19245/74

[51] Int. Cl.[2] ..... A24D 1/18; A24B 3/14

[52] U.S. Cl. ..... 131/2; 131/140 C

[58] Field of Search ..... 131/2, 140 R, 140 C, 131/15 C, 17 A, 17 AB, 17 AC, 17 AD, 17 AE; 162/117, 223, 224; 108/8; 428/343, 356, 495

[56] References Cited

U.S. PATENT DOCUMENTS

| | | | |
|---|---|---|---|
| T912,011 | 7/1973 | Harpham | 131/2 |
| 2,631,954 | 3/1953 | Bright | 428/343 |
| 2,818,824 | 1/1958 | Read et al. | 162/117 UX |
| 2,845,933 | 8/1958 | Samfield et al. | 131/140 C |
| 3,477,440 | 11/1969 | Licis | 131/140 C X |
| 3,545,448 | 12/1970 | Mormon et al. | 131/2 |
| 3,709,232 | 1/1973 | Lilja et al. | 131/140 C |

*Primary Examiner*—Robert W. Michell
*Assistant Examiner*—V. Millin
*Attorney, Agent, or Firm*—Cushman, Darby & Cushman

[57] ABSTRACT

Smoking mixtures in film form comprising binder and filler, optionally with particulate fuel also, uncompacted throughout and having one surface closely configurated with parallel ridges are made by roll-milling a pasty aqueous mass of the ingredients, said mass having a low phase angle e.g. 2° to 45°, and successive rollers of the roll-mill operating at successively higher peripheral speeds with the relative speeds and clearances adjusted to produce the ridges.

20 Claims, 8 Drawing Figures

SMOKING MIXTURES

Figure 1:
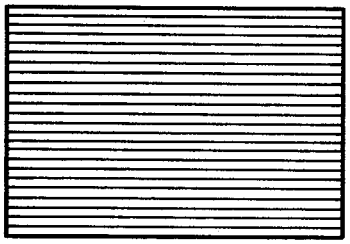

This is a division of application Ser. No. 563,448 filed Mar. 31, 1975, now abandoned.

This invention relates to smoking mixtures, especially tobacco substitutes, in film form and to a process for manufacturing such smoking mixtures.

It is known to manufacture smoking mixtures in film form by passing a pasty aqueous mass of the ingredients through a calender, roll mill or an extruder. Such films can be embossed or crimped in such a way as to reduce the apparent density, but this normally compacts the film in places, leading to non-uniformity of texture.

According to the invention we provide a smoking mixture in film form comprising binder and inorganic filler, the film being uncompacted throughout and having one surface closely configured with parallel ridges.

The other surface of the film may be planar. Additionally the uncompacted film may have an embossed pattern.

Binders used in the smoking mixtures of the invention are preferably water-soluble cellulose ethers, particularly carboxymethycellulose and its salts, but other binders may be used, for example natural gums, guar gums, locust bean gums, starches, pectins, mucilage or polyvinyl alcohol. The binder may incorporate a plasticiser, for example glycerol, ethylene glycol or polyethylene glycol.

If desired the smoking mixtures may contain so much binder that this constitutes substantially the whole of the combustible matter or smoke-producing fuel. Particulate fuel may, however, also be present, for example carbohydrate, e.g. cellulose, modified carbohydrate, carbon or tobacco.

The expression "modified carbohydrate" means a chemically modified carbohydrate and implies that the original carbohydrate has undergone a change of a chemical nature.

Modified carbohydrate present as smoke-producing fuel in the smoking mixtures may desirably comprise a thermally degraded carbohydrate, especially thermally degraded cellulose, prepared for example as described and claimed in our United Kingdom Pat. No. 1,113,979 by subjecting carbohydrate to a catalysed degradation process at a temperature of 100°-250° C (or at higher temperatures as described and claimed in our United Kingdom Patent No. Application 40324/72) until the weight of degraded material is less than 90% of the dry weight of the original carbohydrate.

Further examples of modified carbohydrates which may be present as smoke-producing fuel in the smoking mixtures are oxidised cellulose (see for example Kenyon et al "Industrial and Engineering Chemistry", Volume 41, page 2 et seq).

Smoke-producing fuel in the smoking mixtures may also comprise a solid condensate prepared by acid or base catalysed condensation of a compound of the formula:

$$R^1CO\ CH_2.CH_2\ COR^2$$

(or a precursor thereof) wherein $R^1$ and $R^2$, which may be the same or different, each represents a hydrogen atom, or an alkyl, hydroxyalkyl or formyl group. Such condensates in fabricated form are described and claimed in our United Kingdom Pat. No. 1,298,354.

Inorganic filler is desirably present in high proportion in order to minimise the production of harmful constituents in the smoke. Smoking mixtures containing high proportions of inorganic filler are the subject of our United Kingdom Pat. No. 1,299,296 and of U.S. Pat. No. 1,244,441.

In the smoking mixtures films of the invention the parallel ridges can usually be seen with a naked eye or by the use of a low-powered lens. Typical spacing is about 10–30 ridges per cm for films of 0.04 to 0.30 mm thickness, the preferred films showing spacings of 10 to 20 ridges per cm and having a thickness of 0.06 to 0.10 mm.

The expression "uncompacted" as applied to the smoking mixture films is of generalised intention. The films are not completely homogeneous since they necessarily contain at least two physical phases i.e. a binder phase and an inorganic solid phase, with particulate fuel as an optional third phase. Film cross sections viewed microscopically however do not show gross variation in the distribution of the ingredients within the film, and show no compacting of the ingredients at the bottom of the ridges, such as would lead to significant density variations within the film.

The accompanying drawings show, in enlargement, portions of two smoking mixture films which are embodiments of the invention as well as the roll-mill operation leading to the formation of the smoking mixture films.

Figure 2:
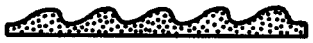
Figure 3:
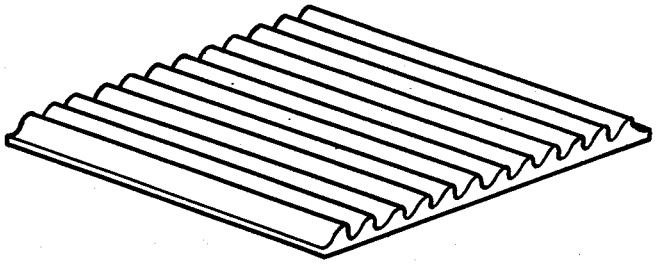

A first embodiment is shown in FIGS. 1–3

FIG. 1 being a plan view

FIG. 2 a section, and

FIG. 3 an isometric drawing.

As best seen in FIGS. 2 and 3 this film has one planar surface and the other surface configured with a series of equidistant parallel ridges all of the same height. Viewed from above therefore the film shows a series of closely spaced equidistant parallel lines on its surface.

Figure 4:
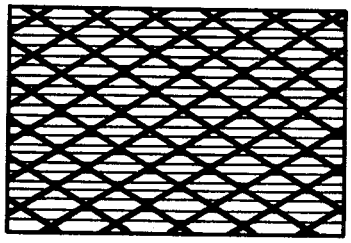
Figure 5:
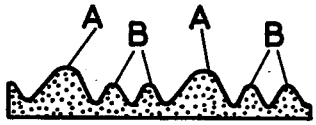
Figure 6:
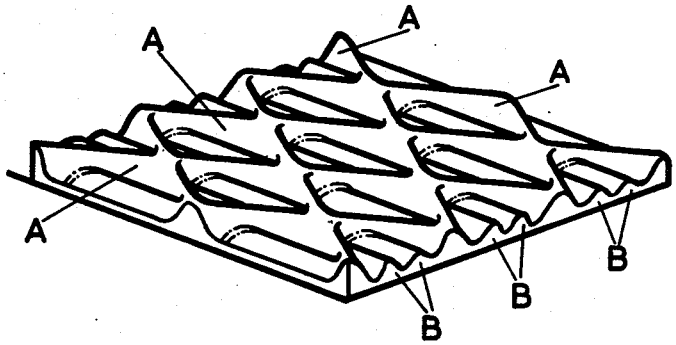

A second embodiment is shown in FIGS. 4–6

FIG. 4 being a plan view

FIG. 5 a section, and

FIG. 6 an isometric drawing. A perspective view is shown in FIGS. 7–8, FIG. 7 being a perspective view of the 3-roll mill, and FIG. 8 being an end view.

This film has one planar surface and the other surface configured with parallel ridges and a diamond pattern. In this particular embodiment shown the ridges (A) formed by the diamond pattern are higher than those of the more closely configured parallel ridges (B), (though this is not necessarily the case). Viewed from above therefore this film shows a prominently diamond patterned surface and less prominently a series of closely spaced equidistant parallel lines running across the diamond pattern.

Figure 7:
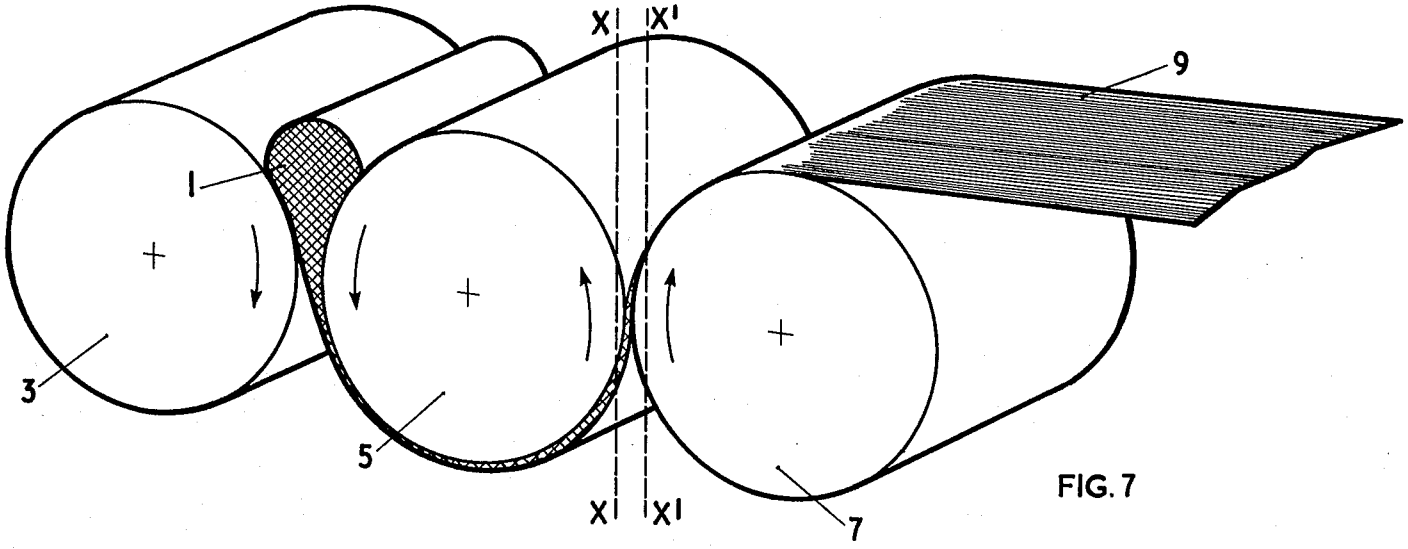
Figure 8:
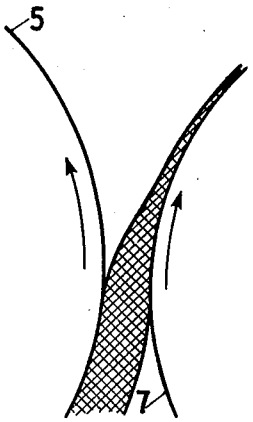

The roll-mill operation leading to the formation of the uncompacted smoking mixture films is shown in FIGS. 7 and 8. FIG. 7 being an end view of the 3-roll-mill as described in example 1 hereinbelow, and FIG. 8 being an enlargement of the Section X—X' shown in FIG. 7.

In consequence of the ridges and the consequential air spaces between them the smoking mixture films of the invention have a lower apparent density than corresponding films with two planar surfaces. By "apparent density" we mean the density as calculated from the weight per unit area and the thickness of the film over the ridges. After shredding to a tobacco-like simulation therefore, the smoking mixtures have improved filling power for cigarettes compared with planar surfaced films, i.e. they have a greater ability to produce cigarettes of standard firmness or feel with less than the usual weight of material. Because the film is uncompacted, the film has excellent combustion properties.

According to a further feature of the invention a process for the production of a smoking mixture film comprises forming a pasty mass containing binder, inorganic filler and water, said pasty mass having a low phase angle i.e. corresponding to a viscoelastic material rather than a viscous liquid, and more particularly having a phase angle of 2° to 45° when tested under oscillatory shear conditions at small amplitudes using a Weissenberg rheogoniometer, and feeding said pasty mass to a roll-mill wherein successive rollers operate at successively higher peripheral speeds, such speeds and the clearance between the rolls being adjusted to produce a film having one surface closely configured with parallel ridges.

When the roll-mill used in the process of the invention has smooth surfaced rollers, then the non-ridged surface of the film is planar.

Determination of the phase angle of a pasty mass is a standard procedure described for example in "Testing of Materials by means of the Rheogoniometer" — K. Weissenberg published by Sangamo Controls Limited of Bognor Regis. The instrument is also described in "Rheology, Theory & Application" by Frederick R. Eirich, Volume II (Academic Press Inc. New York) at page 511.

To carry out the process of the invention the roll clearance settings and relative peripheral speeds have to be adjusted so as to produce the ridged film. The adjustment will depend upon the visco-elasticity i.e. the phase angle of the pasty mass, which in turn will depend upon its constituents, particularly the binder, and the amount of water it contains. Using as binder cellulose ethers and more particularly carboxymethyl cellulose and salts thereof, especially sodium carboxymethyl cellulose pasty masses with phase angle of 2° to 45° generally have solids contents of about 40 to 80% by weight. Using a triple roll mill for example a spring loaded mill it is found that the invention can be operated upon such a mass when the nominal clearance between the rolls is about 0.04 mm. The action of a triple roll mill is illustrated in FIGS. 7 and 8, FIG. 7 being a perspective view of the 3-roll mill as described in Example 1 hereinbelow, and FIG. 8 being an end-view enlargement of the Section X—X' shown in FIG. 7. Peripheral speed ratios between the first, second and third rolls may then be from (e.g.) 1:2:4 to 1:4:25. If a first trial fails to produce the ridged film it is quite simple for the operator to adjust the gap setting and/or the peripheral speeds until the effect is produced. Usually a planar surfaced film or an unsatisfactorily ridged film tends to arise when the roll clearances are too large, when there is insufficient difference between the peripheral speeds of the rollers, or when the pasty mass is of too high viscosity for the clearance settings and/or roller speeds. The number of rollers in the mill used in the process of the invention is not critical. A simple roll-mill comprising two rollers can be used if desired, but better ridged effects are produced using a triple-roll mill or a 4-roll mill, L-mill or Z-mill. If desired the roll mill may carry an endless belt around the final roller, such a belt passing through the nip formed with the penultimate roller.

The invention may advantageously be used to additionally impose parallel ridges during the production of embossed films, thus augmenting or modifying directional characteristics of the film or producing novel surface effects. Thus, for example, in the process of the invention one roller of the roll-mill, or a belt passing between the rollers thereof may carry a surface pattern which is imparted to the pasty mass, and simultaneously, by operating successive rollers at higher peripheral speeds closely configured parallel ridges are formed on one surface.

In such ways films are produced with a combination of parallel ridges and embossed pattern. If desired, for example, by the use of a diamond patterned belt a film may be produced which resembles a woven mesh material and has very low apparent density because of interstices in addition to the parallel ridges. Such films may have for example, at thicknesses of 0.05 to 0.07 mm and basis weight of 35 to 65 g/m$^2$, densities of 0.7 to 0.8 g/cm$^3$.

The invention is illustrated but not limited by the following Example in which the parts and percentages are by weight:

EXAMPLE 1

A pasty mass is prepared by mixing the following ingredients in a sigma-blade mixing machine

| | Parts |
|---|---|
| Sodium carboxymethyl cellulose (Viscosity at 1% solution = 300 cps) | 100 |
| Thermally degraded cellulose (made by impregnation with 5% of ammonium sulphamate and heating at 265° C to a weight loss of 27.5%) | 106 |
| Glycerol | 40 |
| Magnesium carbonate | 112 |
| Calcium carbonate | 65 |
| Water | 348 |

This material is found to have a phase angle of 10°–12° when tested under the standard conditions previously indicated.

With reference to FIG. 7, the pasty material 1 is fed into a triple roll mill comprising rolls 3, 5 and 7 approaching touch conditions, when the mill is idle, between rolls 3 and 5. The pasty material is then fed at a clearance of about 0.04mm between rolls 5 and 7 as more fully illustrated in FIG. 8. Operational speeds are as follows.

Roll Three: 17 RPM — peripheral speed 0.11 m/sec.
Roll Five: 50 RPM — peripheral speed 0.33 m/sec.
Roll Seven: 150 RPM — peripheral speed 1.00 m/sec.

As may be seen from the drawings, stretching and thickness reduction of the pasty mass takes place between rolls 3 and 5. In passing between rolls 5 and 7 further stretching and thickness reduction occurs with the creation of a new stretched and uncompacted surface.

The film taken off the third roll 7 when viewed by electron microscopy is seen to be of uniform consistency, and to be uniformly ridged at a frequency of about 25 ridges per cm. The height of each ridge 9 is about 0.06 to 0.10 mm and the thickness of the film at each trough about 0.03 mm. Thus the ridges can be seen with the naked eye. The apparent density of the film after drying is about 0.6 g/cm$^3$, and the basis weight is about 55 g/m$^2$.

Films made in conventional manner from the same material to a thickness of about 0.08 mm have planar upper and lower surfaces and have basis weights of 85–130 g/cm$^2$ and densities 0.9–1.4 g/cm$^3$ and are therefore less economical because of their small filling power for standard cigarettes.

We claim:

1. A process for the production of a smoking mixture film comprising forming a pasty mass containing combustible binder, inorganic filler and water, said pasty mass having a low phase angle and feeding said pasty mass to a roll-mill wherein successive rollers operate at successively higher peripheral speeds, such speeds and the clearances between the rolls being adjusted to produce a film having one surface closely configured with parallel ridges.

2. A process according to claim 1 wherein the pasty mass has a phase angle of 2° to 45° when tested under oscilliatory shear conditions as hereinbefore indicated.

3. A process according to claim 1 wherein the pasty mass contains as binder carboxymethylcellulose or a salt thereof and has a solids content of 40 to 80% by weight.

4. A process according to claim 3 operated in a triple roll-mill wherein the nominal clearance between the rolls is about 0.04 mm.

5. A process according to claim 4 wherein the peripheral speed ratios between first, second and third rolls of the roll-mill are from 1:2:4 to 1:4:25.

6. A process according to claim 1 operated in a roll-mill carrying an endless belt around the final roller and through the nip formed between the final and penultimate rollers.

7. A process according to claim 1 when used to additionally impose parallel redges during the production of embossed films by means of a roll-mill in which one roller or a belt passing between rollers carries a surface pattern which is imparted to the pasty mass.

8. A smoking mixture comprising combustible binder and inorganic filler produced according to the process of claim 1.

9. A smoking mixture according to claim 8 wherein the other surface of the film is planar.

10. A smoking mixture according to claim 8 in the form of a film of 0.04 to 0.30 mm thickness, with the parallel ridges spaced at 10 to 30 ridges per cm.

11. A smoking mixture according to claim 8 in the form of a film of 0.06 to 0.10 mm thickness, with the parallel ridges spaced at 10 to 20 ridges per cm.

12. A smoking mixture according to claim 8 in the form of a film having additionally an embossed pattern.

13. A smoking mixture according to claim 8 wherein the binder constitutes substantially the whole of the combustible matter.

14. A smoking mixture according to claim 8 wherein the particulate fuel is also present.

15. A smoking mixture according to claim 14 wherein the particulate fuel is a chemically modified carbohydrate.

16. A smoking mixture according to claim 14 wherein the particulate fuel is a thermally degraded carbohydrate prepared by subjecting carbohydrate to a catalysed degradation process at a temperature of at least 100° C until the weight of degraded material is less than 90% of the weight of the original carbohydrate.

17. A smoking material according to claim 17 wherein the particulate fuel is thermally degraded cellulose.

18. A smoking material according to claim 8 wherein the binder is carboxymethylcellulose or a salt thereof.

19. A process for the production of a smoking material by forming a pasty mass containing combustible binder, inorganic filler and water and feeding said pasty mass to a roll mill, characterized in that the pasty mass has a phase angle of 2° to 45° when tested under oscillatory shear conditions, that the nominal clearance between the rolls is adjusted to about 0.04 mm and that the peripheral speed ratios between first, second and third rolls of the roll-mill are adjusted to be from 1:2:4 to 1:4:25.

20. A smoking material produced according to the process of claim 19.

* * * * *